US009170528B2

(12) United States Patent
Torimoto

(10) Patent No.: US 9,170,528 B2
(45) Date of Patent: Oct. 27, 2015

(54) TONER CONTAINER AND IMAGE FORMING APPARATUS HAVING THE SAME

(71) Applicant: KYOCERA Document Solutions Inc., Osaka-shi, Osaka (JP)

(72) Inventor: Masaru Torimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/231,519

(22) Filed: Mar. 31, 2014

(65) Prior Publication Data

US 2015/0063877 A1 Mar. 5, 2015

(30) Foreign Application Priority Data

Aug. 27, 2013 (JP) ..... 2013-175416

(51) Int. Cl.
*G03G 15/08* (2006.01)
*G03G 21/16* (2006.01)

(52) U.S. Cl.
CPC ..... *G03G 15/0865* (2013.01); *G03G 15/0863* (2013.01); *G03G 15/0875* (2013.01); *G03G 21/1676* (2013.01)

(58) Field of Classification Search
CPC ..... G03G 15/0865; G03G 15/0863; G03G 15/0875; G03G 21/1676
USPC ..... 399/12, 107, 111, 120, 258, 262
See application file for complete search history.

(56) References Cited

U.S. PATENT DOCUMENTS

| | | | | |
|---|---|---|---|---|
| 5,629,759 | A * | 5/1997 | Jyoroku | 399/262 |
| 6,438,345 | B1 | 8/2002 | Ban et al. | |
| 2011/0020039 | A1* | 1/2011 | Mitsuishi et al. | 399/262 |
| 2011/0123229 | A1 | 5/2011 | Takashima et al. | |
| 2012/0114391 | A1* | 5/2012 | Horii et al. | 399/262 |
| 2012/0200871 | A1* | 8/2012 | Takahashi et al. | 358/1.9 |
| 2014/0029973 | A1* | 1/2014 | Terazawa et al. | 399/106 |

FOREIGN PATENT DOCUMENTS

| | | | |
|---|---|---|---|
| EP | 1041454 | A1 | 10/2000 |
| JP | 2000347493 | A | 12/2000 |
| JP | 2007316447 | A | 12/2007 |
| JP | 2008224782 | A * | 9/2008 |
| JP | 2010113262 | A | 5/2010 |

OTHER PUBLICATIONS

European Patent Office, Extended European Search Report Issued in Patent Application No. 14161114.5, Apr. 9, 2015, Germany, 6 pages.

* cited by examiner

*Primary Examiner* — Francis Gray
(74) *Attorney, Agent, or Firm* — Alleman Hall McCoy Russell & Tuttle LLP

(57) ABSTRACT

A toner container according to one aspect of the present disclosure is a toner container to be detachably mounted on an image forming apparatus. The toner container includes a container body, a pair of guide portions, and a storage portion. The container body contains toner. The pair of guide portions are provided on a bottom surface of the container body and allow the container body to be guided in a mounting direction toward a mounting position that allows toner to be supplied from the container body to the image forming apparatus. The storage portion is attached at a predetermined position between the pair of guide portions on the bottom surface of the container body. The storage portion stores information about toner contained in the container body.

14 Claims, 12 Drawing Sheets

TONER CONTAINER AND IMAGE FORMING APPARATUS HAVING THE SAME

INCORPORATION BY REFERENCE

This application is based upon and claims the benefit of priority from the corresponding Japanese Patent Application No. 2013-175416 filed on Aug. 27, 2013, the entire contents of which are incorporated herein by reference.

BACKGROUND

The present disclosure relates to a toner container to be detachably mounted on an image forming apparatus, and an image forming apparatus having the toner container.

Developing devices are mounted to image forming apparatuses, such as copy machines and printers, which form images on print sheets by electrophotography. In the developing device, developer including toner is stored. The developing device develops an electrostatic latent image formed on an image carrier such as a photosensitive drum by using the toner included in the developer. Toner in the developing device is reduced by the development being performed. Therefore, the image forming apparatus is structured so as to include a toner container in which toner is stored, and additionally supply toner from the toner container to the developing device. Further, the toner container is detachably mounted to the image forming apparatus. When the toner in the toner container is all consumed, the toner container is exchanged for a new toner container that is filled with toner.

On a surface of a toner container of this type, a storage portion referred to as a memory chip is attached which stores information about the toner container, information about toner, etc. Therefore, when the toner container is mounted on the image forming apparatus, a reading portion provided in the image forming apparatus electrically contacts the storage portion, whereby the information stored in the storage portion is read.

Since the storage portion is attached on the surface of the toner container in an exposed manner, the storage portion is likely to be subjected to physical contact. If the storage portion is broken by physical contact, the image forming apparatus cannot acquire information about an exchanged toner container or information about toner thereof, and this may cause a problem with image forming operation or developing operation.

SUMMARY

A toner container according to one aspect of the present disclosure is a toner container to be detachably mounted on an image forming apparatus. The toner container includes a container body, a pair of guide portions, and a storage portion. The container body contains toner. The pair of guide portions are provided on a bottom surface of the container body and allow the container body to be guided in a mounting direction toward a mounting position that allows toner to be supplied from the container body to the image forming apparatus. The storage portion is attached at a predetermined position between the pair of guide portions on the bottom surface of the container body. The storage portion stores information about toner contained in the container body.

An image forming apparatus according to another aspect of the present disclosure includes a toner container, a container mounting portion, and an image forming portion. The toner container includes a container body, a pair of guide portions, and a storage portion. The container body contains toner. The pair of guide portions are provided on a bottom surface of the container body and allow the container body to be guided in a mounting direction toward a mounting position that allows toner to be supplied from the container body to the image forming portion. The storage portion is attached at a predetermined position between the pair of guide portions on the bottom surface of the container body. The storage portion stores information about toner contained in the container body. The container mounting portion includes guide ditches allowing the guide portions of the toner container to be inserted therein. The image forming portion forms an image on a sheet-like recording medium by using toner supplied from the toner container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
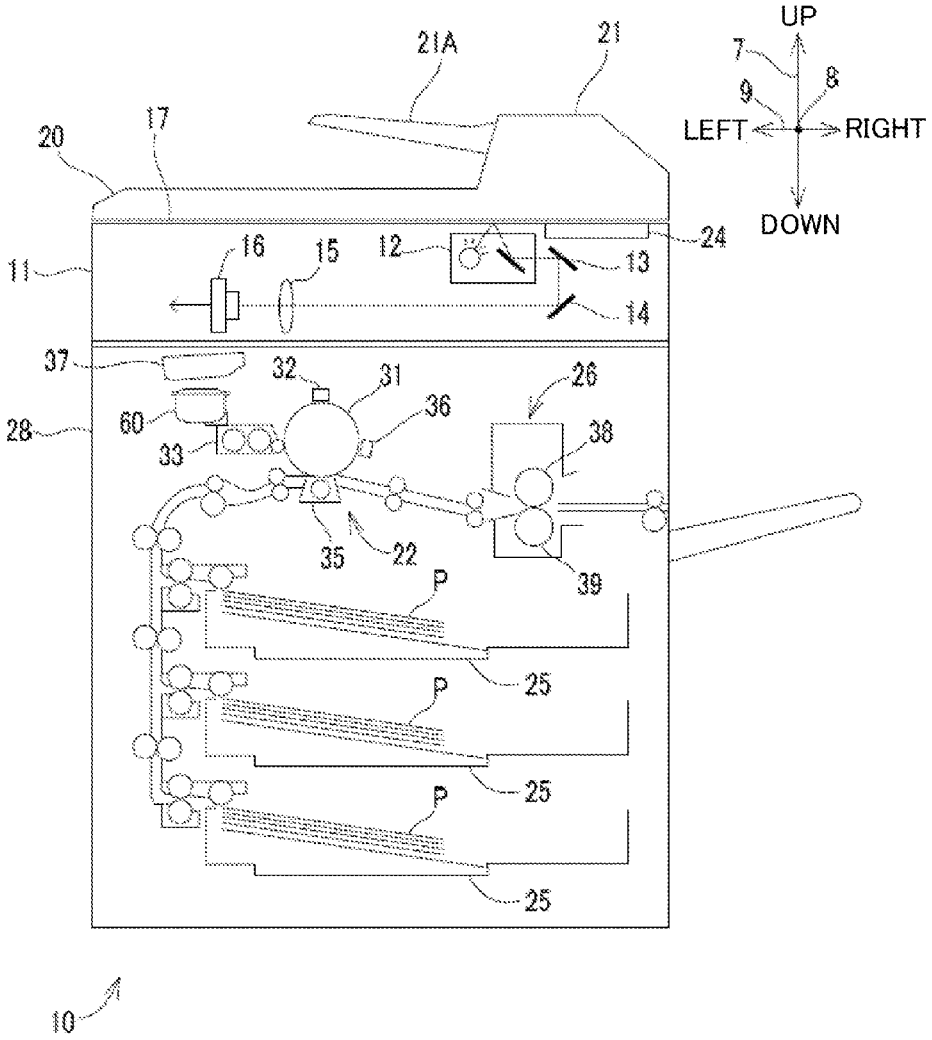
FIG. 1 shows the structure of an image forming apparatus according to an embodiment of the present disclosure.

Hereinafter, a toner container 60 and an image forming apparatus 10 according to an embodiment of the present disclosure will be described with reference to the drawings. In the below description, an up-down direction 7 is defined based on a state where the image forming apparatus 10 is installed on a flat plane. Further, a front-rear direction 8 is defined based on the near side (front surface side) representing a side on which the toner container 60 is inserted. Further, a right-left direction 9 is defined by the image forming apparatus 10 being viewed from the near side (the front surface side).

[Schematic Structure of Image Forming Apparatus 10]

The image forming apparatus 10 is an apparatus that has at least a printing function, and is implemented as, for example, a multifunction peripheral. The image forming apparatus 10 prints an image on a print sheet P (recording medium) that is a sheet-like medium, by using developer including toner. The image forming apparatus 10 is not limited to a multifunction peripheral, and may be a single function machine such as a printer, a FAX apparatus, or a copy machine.

As shown in FIG. 1, the image forming apparatus 10 mainly includes an image reading portion 11, a document sheet cover 20, an ADF (Automatic Document Feeder) 21, an image forming portion 22, an operation display portion 24, a sheet feed device 25, a fixing device 26, a container mounting portion 40, a lock member 90, the toner container 60, and a control portion (not shown) that comprehensively controls the image forming apparatus 10. These components are mounted to a casing 28 that forms an external frame (not shown), an internal frame 29 (see FIG. 2), and the like of the image forming apparatus 10.

The image reading portion 11 executes an image reading process in which image data is read from a document sheet placed on a contact glass 17. As shown in FIG. 1, the image reading portion 11 includes a reading unit 12, mirrors 13 and 14, an optical lens 15, a CCD 16, and the like. The reading unit 12 includes, for example, a light source such as a LED, and can be moved in a secondary scanning direction (the right-left direction 9 in FIG. 1) by a not-illustrated moving mechanism using a motor such as a stepping motor. When the reading unit 12 is moved in the secondary scanning direction by the motor, scanning in the secondary scanning direction is performed with light applied from the light source toward the contact glass 17 of the image reading portion 11. The light is reflected by a document sheet toward the mirror 13 due to this scanning, and is further guided to the optical lens 15 by the mirror 14. The optical lens 15 focuses the incident light on the CCD 16. The CCD 16 outputs, to the control portion, data representing an amount of light that corresponds to an amount of received light. When the control portion obtains data representing an amount of light for the entire region to which the light is applied, the control portion processes the data representing the amount of light, thereby generating image data of the document sheet based on the data representing the amount of light. In the present embodiment, an exemplary case where the CCD 16 is used as an imaging device is described. However, instead of the reading mechanism using the CCD 16, a reading mechanism that includes a contact image sensor (CIS) having a focal length shorter than the CCD 16 may be used.

The ADF 21 is mounted in the document sheet cover 20. The ADF 21 sequentially conveys document sheets that are set in a document sheet setting portion 21A, by a plurality of conveying rollers (not shown), and moves the document sheets, through a reading position defined on the contact glass 17, rightward in the secondary scanning direction. When the document sheets are moved by the ADF 21, the reading unit 12 is positioned at a position below the reading position, and an image of the document sheet being moved is read at this position by the reading unit 12.

The image forming portion 22 executes an image forming process in which an image is formed on a print sheet P according to a so-called electrophotography. The image forming portion 22 prints an image on the print sheet P based on image data read by the image reading portion 11, or image data inputted from the outside through a not-illustrated network communication portion. For example, when a printing job is transferred from a personal computer, the image forming portion 22 prints an image on the print sheet P based on image data and printing condition indicated by the printing job. As shown in FIG. 1, the image forming portion 22 includes a photosensitive drum 31, a charging device 32, a developing device 33, a transfer device 35, an electricity eliminating device 36, an exposure device (LSU: Laser Scanner Unit) 37, and the like.

When the image forming process by the image forming portion 22 is started, the surface of the photosensitive drum 31 is charged to have a uniform potential by the charging device 32. Scanning is performed on the photosensitive drum 31 by the exposure device 37, with laser light corresponding to the image data. Thus, an electrostatic latent image is formed on the photosensitive drum 31. Thereafter, toner is adhered to the electrostatic latent image by developing process of the developing device 33, to form a toner image on the photosensitive drum 31. The toner image is transferred, by the transfer device 35, to a print sheet P being conveyed in a conveying path. The print sheet P having the toner image transferred thereto is conveyed to the fixing device 26 disposed downstream (the right side in FIG. 1) of the image forming portion 22 in a direction in which the print sheet P is conveyed.

The fixing device 26 fixes, by heat, the toner image transferred to the print sheet P, onto the same print sheet P. The fixing device 26 includes a heating roller 38 and a pressure roller 39. The pressure roller 39 is urged toward the heating roller 38, by an elastic member such as a spring. Thus, the pressure roller 39 is pressed against the heating roller 38. The heating roller 38 is heated to a high temperature by a heater when the fixing operation is performed. When the print sheet P passes through the fixing device 26, toner of the toner image is heated by the heating roller 38 and fused, and the print sheet P is pressed by the pressure roller 39. Thus, toner is fixed onto the print sheet P by the fixing device 26, and an image is formed on the print sheet P.

[Structure of Container Mounting Portion 40]

Figure 2:
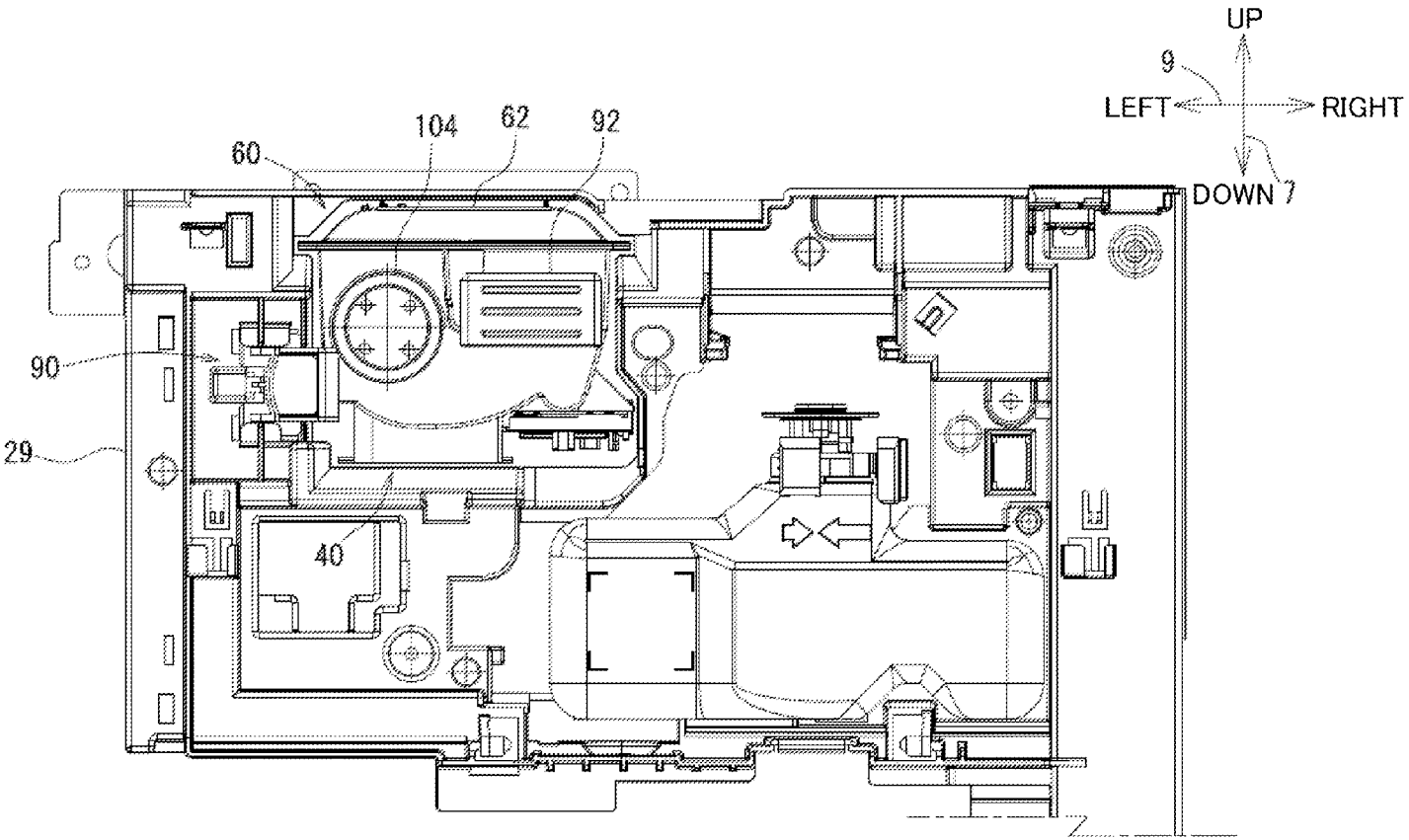
FIG. 2 shows the state in which a toner container according to the embodiment of the present disclosure is mounted on the image forming apparatus shown in FIG. 1.
Figure 3:
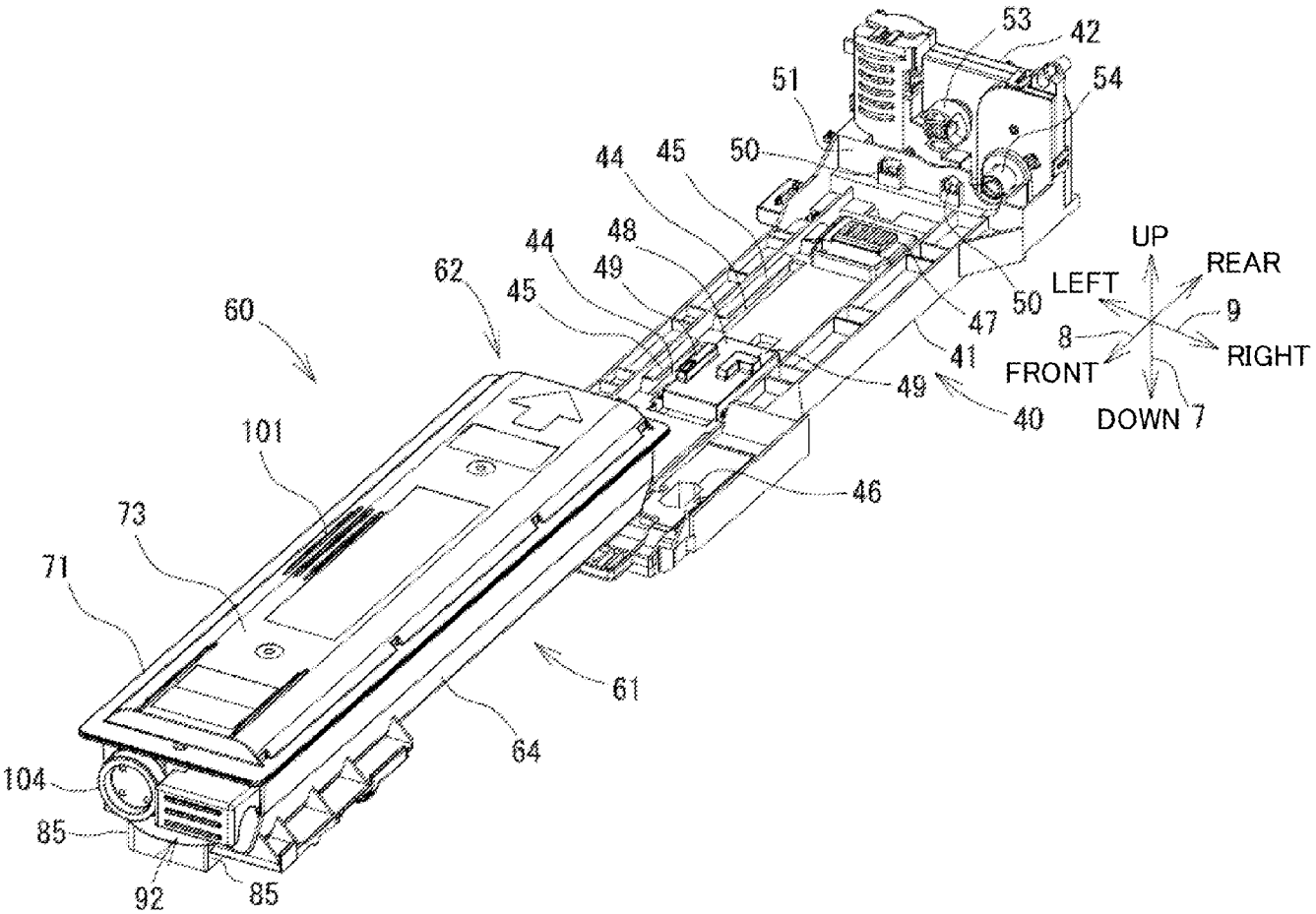
FIG. 3 is a perspective view showing a container mounting portion of the image forming apparatus shown in FIG. 1 and the toner container according to the embodiment of the present disclosure.

As shown in FIG. 2, the container mounting portion 40 is fixed on the internal frame 29 of the casing 28. The container mounting portion 40 allows the toner container 60 to be detachably attached thereon. That is, the toner container 60 is detachably mounted on the image forming apparatus 10 by the container mounting portion 40. The container mounting portion 40 supports the toner container 60 so as to be slidable in the front-rear direction 8 (insertion-extraction direction). As shown in FIG. 3, the container mounting portion 40 includes a support table 41 and a drive transmission portion 42. The support table 41 supports the toner container 60 from a bottom surface 64 thereof, and has a plate-like shape elongated in the front-rear direction 8. A pair of guide ditches 44 extending in the front-rear direction 8 are provided on an upper surface of the support table 41. The pair of guide ditches 44 are respectively located being separated from each other in the right-left direction 9. The pair of guide ditches 44 are for guiding the toner container 60 in the front-rear direction 8. Rail-like guide portions 85 described later, which are provided on the bottom surface 64 of the toner container 60, are inserted into the pair of guide ditches 44. Thus, the toner container 60 is supported by the container mounting portion 40 so as to be slidable in the front-rear direction 8. It is noted that the guide ditches 44 may extend continuously and linearly along the front-rear direction 8, or may be provided discontinuously along the front-rear direction 8.

Each guide ditch 44 is provided with an eave-like restriction piece 45 protruding toward the ditch center. The restriction piece 45 of the guide ditch 44 located at the left in FIG. 3 protrudes from a left end of the guide ditch 44 toward the ditch center. The restriction piece 45 of the guide ditch 44 located at the right in FIG. 3 protrudes from a right end of the guide ditch 44 toward the ditch center. Upon insertion of the toner container 60, these restriction pieces 45 are engaged, in the up-down direction 7, with protrusion pieces 88 (see FIG. 4) described later which are provided on the guide portions 85. Thus, movement of the toner container 60 in the up-down direction 7 is restricted.

As shown in FIG. 3, a through hole 46 penetrating in the up-down direction 7 is provided in the vicinity of the front end of the support table 41. The through hole 46 is a toner conveyance path for sending toner supplied from a supply opening 67 (see FIG. 5) of the toner container 60, to the developing device 33 when the toner container 60 is mounted on the container mounting portion 40. In the present embodiment, when the toner container 60 is mounted at a predetermined mounting position on the container mounting portion 40, the supply opening 67 of the toner container 60 is located over the through hole 46. That is, the mounting position is a position where toner can be supplied from a container body 61 of the toner container 60 to the developing device 33.

A contact terminal 47 that allows electric connection is provided on the upper surface of the support table 41. The contact terminal 47 is located at the periphery of the rear end on the upper surface of the support table 41. When the toner container 60 is mounted at the mounting position on the container mounting portion 40, the contact terminal 47 electrically contacts a terminal of a storage portion 76 (see FIG. 5) described later which is provided on the toner container 60.

In addition, an identification portion 48 which determines whether or not to permit the mounting of the toner container 60 is provided on the upper surface of the support table 41. The identification portion 48 is located in the vicinity of the center in the front-rear direction 8 on the upper surface of the support table 41. The identification portion 48 has a projection 49 having a predetermined pattern shape. When the toner container 60 having an identified portion 79 (see FIG. 5) having a pattern shape corresponding to the projection 49 is inserted, the insertion is permitted so that the toner container 60 can be inserted up to the mounting position. It is noted that when a toner container 60 having another identified portion 79 not corresponding to the projection 49 is inserted, the insertion of the toner container 60 is restricted by the identification portion 48.

Two positioning holes 50 are provided at a rear end of the support table 41. The positioning holes 50 are used for positioning the toner container 60 at the mounting position when the toner container 60 is mounted on the container mounting portion 40. The positioning holes 50 are provided in a wall surface 51 extending upward from a rear end of the upper surface of the support table 41. The positioning holes 50 are through holes penetrating rearward from the wall surface 51. When positioning members 82 (see FIG. 5) described later which are provided on the toner container 60 are inserted into the positioning holes 50, the toner container 60 is positioned at the mounting position, whereby the toner container 60 is securely mounted at the mounting position.

Figure 6:
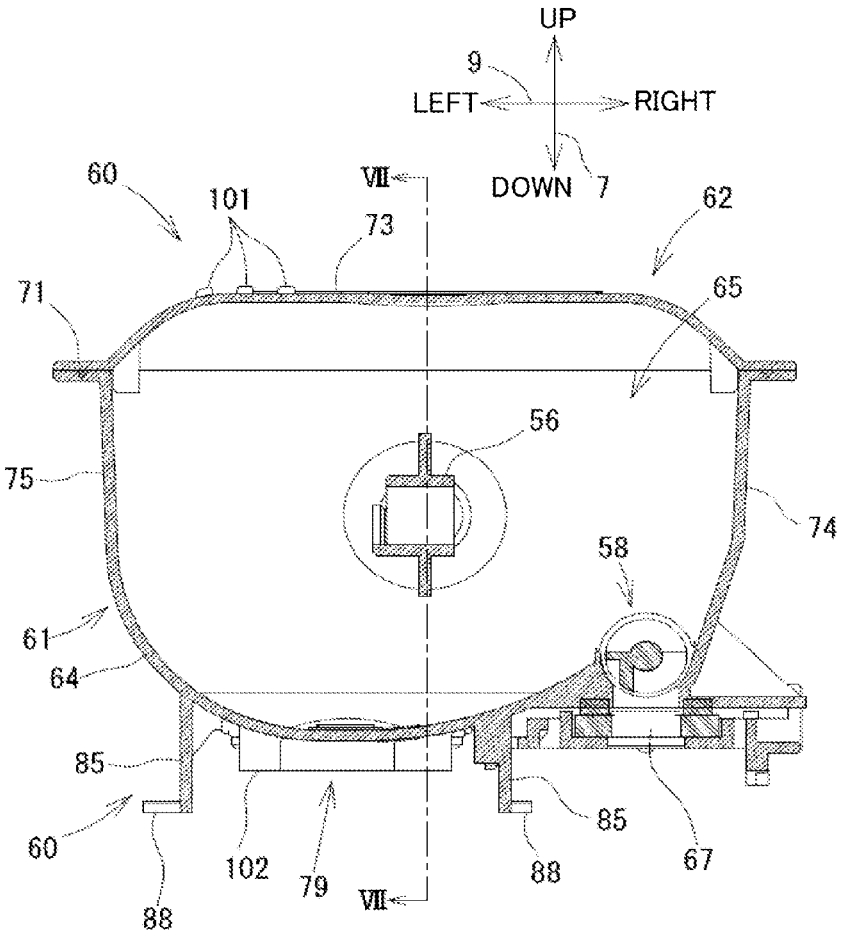
FIG. 6 is a sectional view showing a sectional structure along a plane VI-VI in FIG. 4.

As shown in FIG. 3, two joints 53 and 54 are provided on the drive transmission portion 42. Rotational driving force from a motor (not shown) is transmitted to each of the joints 53 and 54. The joint 53 is located substantially at the center of the drive transmission portion 42. When the toner container 60 is mounted on the container mounting portion 40, the joint 53 is joined with a joint 57 (see FIG. 7) of an agitating paddle 56 (see FIGS. 6 and 7) provided inside the toner container 60. The joint 54 is located at a lower right corner of the drive transmission portion 42. When the toner container 60 is mounted on the container mounting portion 40, the joint 54 is joined with a joint 59 (see FIG. 8) of a spiral axis 58 (see FIG. 6) provided inside the toner container 60.

[Structure of Lock Member 90]

FIG. 2 shows the state in which the toner container 60 is mounted on the container mounting portion 40. FIG. 2 shows the structure of the periphery of the container mounting portion 40 being exposed on the front surface side when a front cover of the image forming apparatus 10 is detached. As shown in FIG. 2, the lock member 90 is attached on the internal frame 29 of the casing 28. More specifically, the lock member 90 is supported by the internal frame 9 so as to be movable in the right-left direction 9. When the toner container 60 is mounted at the mounting position on the container mounting portion 40, the lock member 90 is engaged with a protruding portion 98 (see FIG. 10) described later which is provided on the toner container 60, whereby the toner container 60 is fixed at the mounting position. The lock member 90 is formed in a nail shape, for example. In the present embodiment, the lock member 90 is supported so as to be movable between a lock position (position shown in FIG. 2) where movement of the toner container 60 to the near side is restricted by the lock member 90 engaging with the protruding portion 98, and an unlock position which is moved leftward from the lock position and allows the toner container 60 to be extracted to the near side from the container mounting portion 40. The lock member 90 is urged toward the lock position by an elastic member such as a spring, for example. When a user moves the lock member 90 from the lock position to the unlocked position, lock of the toner container 60 by the lock member 90 is released.

[Structure of Toner Container 60]

Hereinafter, the structure of the toner container 60 will be described in detail with reference to FIGS. 3 to 11. It is noted that in each drawing, with reference to the orientation (mounted orientation) of the toner container 60 when mounted on the casing 28, the vertical direction is defined as the up-down direction 7, the insertion-extraction direction with respect to the casing 28 is defined as the front-rear direction 8, and the horizontal direction as seen from the front side in the case of the mounted orientation is defined as the right-left direction 9.

The toner container 60 is for supplying toner to the developing device 33. As shown in FIG. 1, the toner container 60 is located at the upper left portion of the casing 28. More specifically, the toner container 60 is located at the left above the developing device 33. The toner container 60 is configured to be attachable and detachable with respect to the container mounting portion 40 provided on the casing 28, and is supported so as to be slidable in the front-rear direction 8 so that the toner container 60 can be inserted or extracted with respect to the container mounting portion 40.

As shown in FIG. 3, the toner container 60 has a shape elongated in the front-rear direction 8. The toner container 60 includes the container body 61 and a lid component 62.

The container body 61 is for containing toner and has a box-like shape elongated in the front-rear direction 8. The container body 61 has a bottom surface 64 having substantially an arc shape curved downward, and an opening 65 (see FIG. 6) having a rectangular shape that widely opens on the upper surface. In the container body 61, toner to be used for developing processing by the developing device 33 is contained. The container body 61 is a synthetic resin product formed by injection molding in which melted synthetic resin is injected into a mold. Generally, melted synthetic resin is contracted when cooled and solidified. Therefore, in order to prevent occurrence of a so-called "sink mark" on a surface of the container body 61 due to contraction, the container body 61 is formed such that any portion thereof has a uniformed thickness. That is, any portion of the outer wall of the container body 61 is formed so as to have a uniformed thickness. It is noted that "sink mark" refers to deformation such as concave, dent, or distortion due to a contraction difference caused by thickness unevenness on a synthetic resin product. As a material for the container body 61, thermoplastic synthetic resin can be used. Specifically, ABS resin, PET (polyethylene terephthalate) resin, or synthetic resin mainly composed of such resin is used as a material for the container body 61.

The lid component 62 has a shape corresponding to the opening 65 on the upper surface of the container body 61, the shape being a rectangular shape elongated in the front-rear direction 8. The lid component 62 is for covering the opening 65 of the container body 61, and includes an outer circumferential portion 71 contacting the circumferential edge of the opening 65, and an inner wall portion 73 slightly bulging from the outer circumferential portion 71. The lid component 62 is a synthetic resin product formed by injection molding as in the container body 61.

Figure 5:
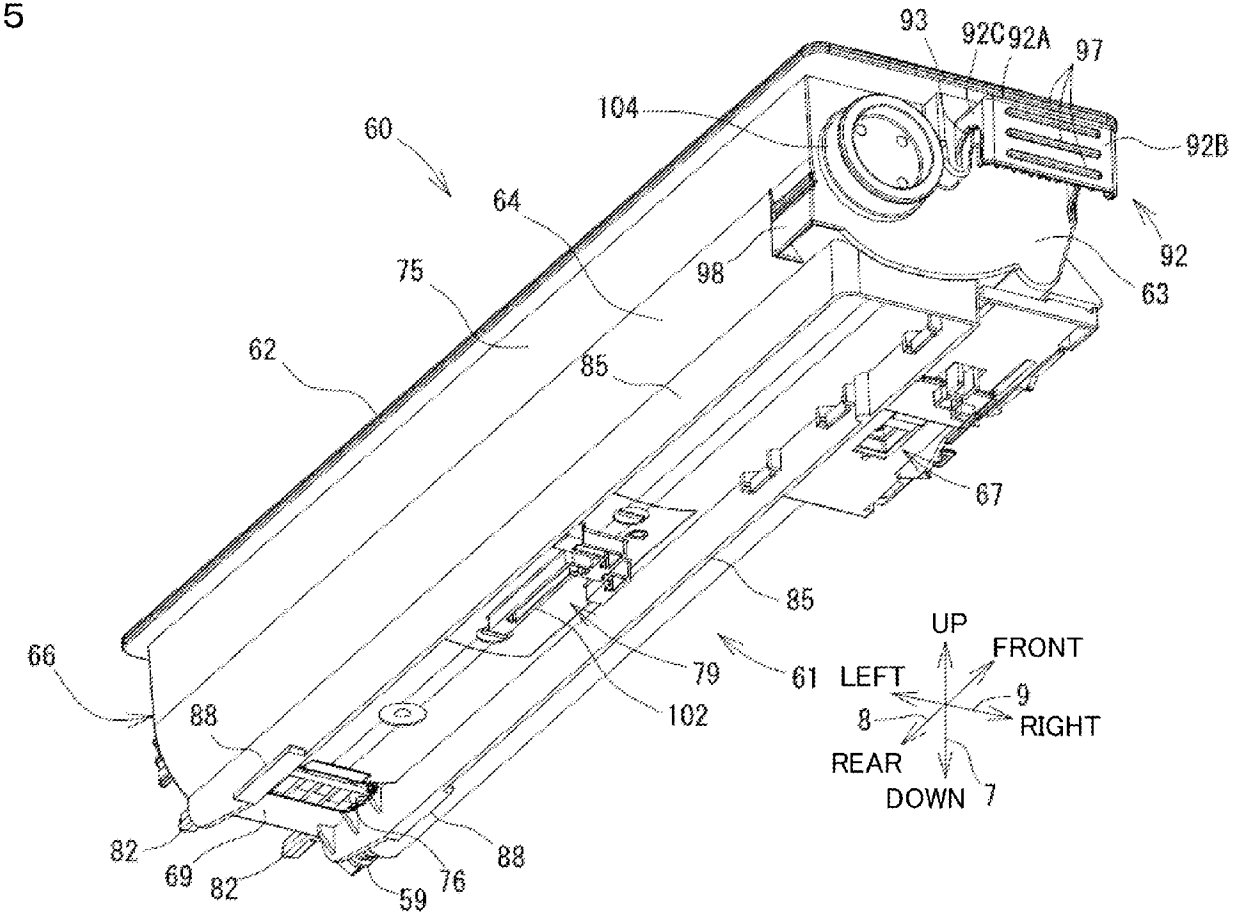
FIG. 5 is a perspective view showing the structure of the toner container shown in FIG. 3 as seen obliquely from below.

As shown in FIG. 5, the container body 61 is provided with a pair of guide portions 85. The guide portions 85 are provided on the bottom surface 64 of the container body 61. The pair of guide portions 85 enable the container body 61 to be guided in a mounting direction toward the mounting position when the toner container 60 is inserted onto the container mounting portion 40. Specifically, the pair of guide portions 85 each have a thin-width rail shape extending in the mounting direction (direction coinciding with the front-rear direction 8). The pair of guide portions 85 are located at positions corresponding to the respective guide ditches 44 (see FIG. 3) on the bottom surface 64. The guide portions 85 are inserted into the guide ditches 44 and guided along the guide ditches 44, whereby the container body 61 is guided in the mounting direction. In the present embodiment, the guide portions 85 extend up to a far-side surface 66 on the rear side of the container body 61.

The guide portions 85 protrude in a direction perpendicular to the bottom surface 64, and the protrusion pieces 88 are provided at ends of the guide portions 85. One protrusion piece 88 is provided on each guide portion 85. The protrusion pieces 88 protrude in the right-left direction 9 (orthogonal direction) orthogonal to side surfaces of the respective guide portions 85. The protrusion piece 88 of the guide portion 85 located at the left in FIG. 5 protrudes leftward from the end of the guide portion 85. The protrusion piece 88 of the guide portion 85 located at the right in FIG. 5 protrudes rightward from the end of the guide portion 85. In the present embodiment, the protrusion pieces 88 are provided on the far-side surface 66 side of the guide portion 85.

When the toner container 60 is inserted onto the container mounting portion 40, the guide portions 85 are inserted into the guide ditch 44. In the state where the guide portions 85 are inserted into the guide ditches 44, the movement direction of the guide portions 85 is restricted to a direction along the guide ditches 44. In addition, in the state where the guide portions 85 are inserted into the guide ditches 44, the protrusion pieces 88 of the guide portions 85 are engaged with the restriction pieces 45 of the guide ditches 44, whereby movement of the protrusion pieces 88 in the up-down direction 7 is restricted. In other words, when the toner container 60 is inserted onto the container mounting portion 40 rearward (mounting direction) in the front-rear direction 8, the guide portions 85 guide the container body 61 rearward along the guide ditches 44 while positioning the container body 61 so as not to be displaced in the right-left direction 9. In addition, when the toner container 60 is inserted onto the container mounting portion 40 rearward (mounting direction) in the front-rear direction 8, the protrusion pieces 88 guide the container body 61 rearward while positioning the container body 61 so as not to be displaced in the up-down direction 7 which is perpendicular to the bottom surface 64.

Since such guide portions 85 are provided, rattling in the up-down direction 7 as well as rattling in the right-left direction 9 is prevented by the guide portions 85. As a result, the toner container 60 can be smoothly handled in insertion work upon mounting and drawing work upon extraction, whereby operability upon mounting or extraction of the toner container 60 can be improved.

Figure 7:
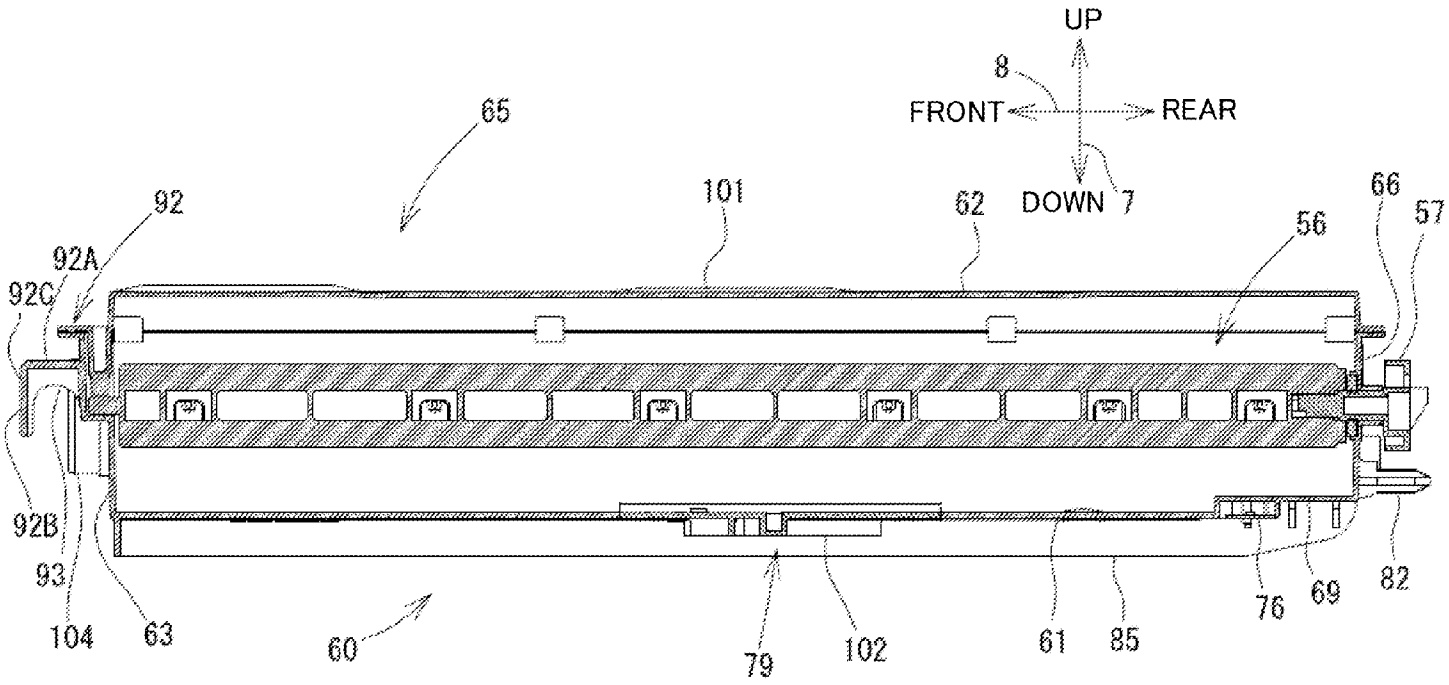
FIG. 7 is a sectional view showing a sectional structure along a plane VII VII in FIG. 6.

In addition, as shown in FIGS. 5 and 7, two positioning members 82 having a pin shape are provided on the far-side surface 66 of the container body 61. The positioning members 82 protrude rearward from the far-side surface 66. The positioning members 82 are located at positions corresponding to the respective positioning holes 50 of the container mounting portion 40. When the toner container 60 is mounted at the mounting position on the container mounting portion 40, the positioning members 82 are inserted into the positioning holes 50. Thus, the toner container 60 is positioned at the mounting position on the container mounting portion 40, whereby the toner container 60 is securely mounted at the mounting position.

As described above, the container body 61 is formed by performing injection molding of melted synthetic resin using a mold. The container body 61 as such a synthetic resin product needs a mold for forming the curved bottom surface 64 side and a mold for forming the upper surface side of the container body 61. In addition, since the protrusion pieces 88 provided on the far-side surface 66 side protrude in the right-left direction 9 and the positioning members 82 protrude in the front-rear direction 8, these portions cannot be formed by only the two molds described above. That is, a slide core (slide mold) is needed for forming a far end portion on the rear side including the far-side surface 66 of the container body 61. The slide core is slid rearward upon demolding. In the present embodiment, since the protrusion pieces 88 and the positioning members 82 are provided on the rear side of the container body 61, they can be formed by injection molding using the slide core.

Figure 8:
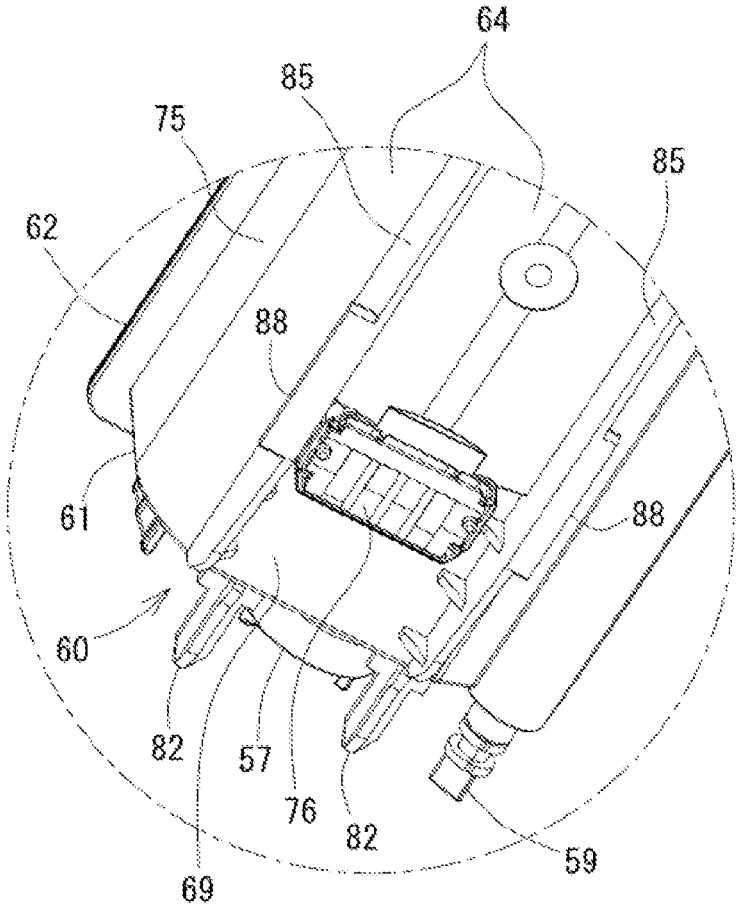
FIG. 8 shows a peripheral structure of a storage portion of the toner container shown in FIG. 3.

As shown in FIG. 8, the storage portion 76 including a terminal portion and a memory portion exposed outside like a chip memory is provided on the bottom surface 64 of the container body 61. The storage portion 76 stores information about toner contained in the container body 61. Examples of information about toner include the amount of toner contained in an unused toner container, the time when toner was contained, and a condition that allows application of contained toner. The storage portion 76 is located, in an area between the pair of guide portions 85, on the rear end side on the bottom surface 64, that is, at an end portion on the far-side surface 66 side where the positioning members 82 are provided. In the present embodiment, the storage portion 76 is located in the vicinity of the protrusion pieces 88 of the guide portions 85. Specifically, the storage portion 76 is located at a position between the protrusion pieces 88.

In addition, as shown in FIG. 7, a depression portion 69 which is depressed relative to the bottom surface 64 is provided on the rear end side of the bottom surface 64. The depth of the depression portion 69 is equal to the thickness of the storage portion 76. The storage portion 76 is provided on the depression portion 69 thus formed.

Thus, since the storage portion 76 is provided between the pair of guide portions 85, the storage portion 76 is protected from physical contact from outside, by the guide portions 85 and the protrusion pieces 88. That is, even if the bottom surface 64 side receives impact during conveyance or handling of the toner container 60, only the guide portion 85 or the protrusion piece 88 receives direct impact while the storage portion 76 does not receive direct impact. Thus, damage of the storage portion 76 due to direct impact can be prevented.

In addition, in the present embodiment, since the positioning members 82 are provided on the far-side surface 66 as described above, the rear end of the toner container 60 is positioned with highest accuracy when the toner container 60 is mounted at the mounting position on the container mounting portion 40. Therefore, since the storage portion 76 is located on the rear end side on the bottom surface 64, that is, in the vicinity of the positioning members 82, a terminal of the storage portion 76 contacts the contact terminal 47 of the container mounting portion 40 without position displacement therebetween. Thus, contact failure between the terminals is prevented, and the information about toner stored in the storage portion 76 is reliably transmitted to the image forming apparatus 10.

In addition, since the storage portion 76 is located on the depression portion 69, it is not necessary to make the protruding height of the guide portions 85 higher than the thickness of the storage portion 76, so that the design freedom of height dimension of the guide portion 85 is improved.

In the present embodiment, the storage portion 76 having a terminal to contact the contact terminal 47 of the container mounting portion 40 is employed as an example. However, instead of the storage portion 76, a storage portion that transmits information stored therein by noncontact system like RFID may be applied.

Figure 4:
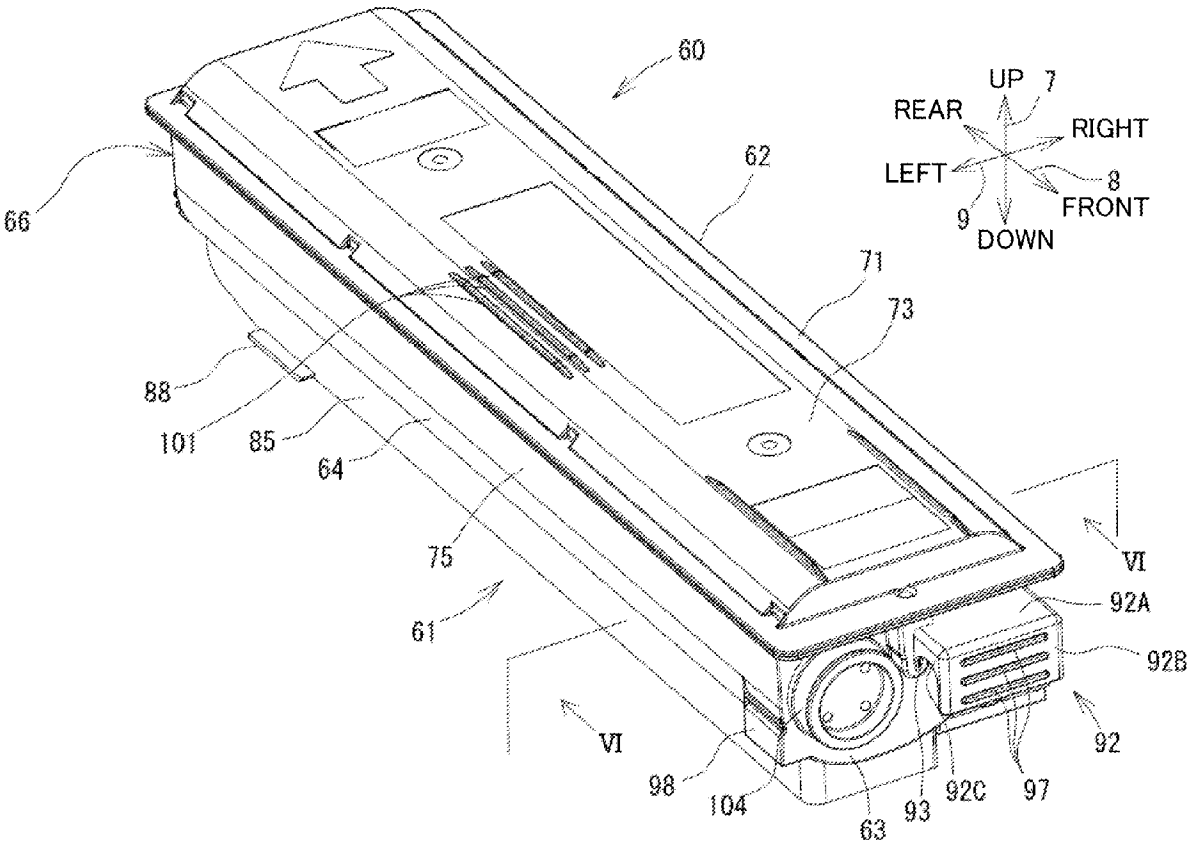
FIG. 4 is a perspective view showing the structure of the toner container shown in FIG. 3 as seen obliquely from above.

As shown in FIG. 4, a handle 92 is provided on a side surface 63 (first side surface) on the front side of the container body 61. More specifically, the handle 92 is provided on the side surface 63 which is one of the side surfaces in the longitudinal direction of the container body 61 and is located on the front side when the container body 61 is mounted on the container mounting portion 40. The handle 92 is a portion to be held by a user when the toner container 60 is mounted or detached with respect to the container mounting portion 40 or when the toner container 60 is carried.

A first slip stopper portion 101 for preventing slip, which extends in a direction (direction coinciding with the front-rear direction 8) perpendicular to the side surface 63, is provided on the upper surface of the lid component 62. The first slip stopper portion 101 is a portion to be held by a user when the toner container 60 is mounted or detached with respect to the container mounting portion 40 or when the toner container 60 is carried. The first slip stopper portion 101 is formed by three ribs extending in the front-rear direction 8. The first slip stopper portion 101 is located at the center in the front-rear direction 8 on the upper surface of the lid component 62. It is noted that the number of the ribs is not limited to three. One or two ribs may be provided or four or more ribs may be provided, as long as slip prevention can be realized. The first slip stopper portion 101 is not limited to formation by ribs. A plurality of ball-like protruding portions may be provided or a rubber sheet may be pasted.

In the present embodiment, the handle 92 is located near a right side surface 74 (second side surface, see FIG. 6) which is adjacent to the side surface 63. That is, the handle 92 is located near the right end on the side surface 63. On the other hand, the first slip stopper portion 101 is located near a left side surface 75 (third side surface) adjacent to the side surface 63 and opposing to the right side surface 74. That is, the first slip stopper portion 101 is located near the left end on the upper surface of the lid component 62.

Since the handle 92 and the first slip stopper portion 101 are located in the above positional relationship, slip is prevented when a user holds the toner container 60, and in addition, the toner container 60 becomes easy to be held with both hands, whereby operability is improved upon handling of the toner container 60. For example, even when a heavy toner container 60 filled with large amount of toner is mounted on the container mounting portion 40, the handle 92 is held with a right hand and a left end portion including the slip stopper portion 101 is held with a left hand, whereby the toner container 60 can be stably handled without being slipped from the hands.

In addition, as shown in FIG. 5, the identified portion 79 having a pattern shape corresponding to the projection 49 of the identification portion 48 is provided on the bottom surface 64. The identified portion 79 is used for identifying whether or not the toner container 60 conforms to the image forming apparatus 10. If the identified portion 79 is not hindered by the identification portion 48 when the toner container 60 is inserted onto the container mounting portion 40, it can be determined that the toner container 60 conforms to the image forming apparatus 10. On the other hand, the identified portion 79 is hindered by the identification portion 48 so that the toner container 60 cannot be inserted onto the container mounting portion 40, it can be determined that the toner container 60 does not conform to the image forming apparatus 10. The identified portion 79 is located at a position corresponding to the first slip stopper portion 101 on the bottom surface 64. The identified portion 79 includes a second slip stopper portion 102 for preventing slip which extends in the front-rear direction 8 which is a direction perpendicular to the side surface 63. The second slip stopper portion 102 is located at the center in the front-rear direction 8 on the bottom surface 64 and near the left end.

Since the second slip stopper portion 102 is provided on the bottom surface 64, a user can put fingers on both the first slip stopper portion 101 and the second slip stopper portion 102 when a user holds a left end portion of the toner container 60 with the left hand. Thus, the user can securely hold the toner 60 without the toner 60 slipping and dropping.

In the present embodiment, the supply opening 67 is provided on the bottom surface 64. The supply opening 67 is an opening for sending toner contained in the toner container 60 to the developing device 33 when the toner container 60 is mounted at the mounting position on the container mounting portion 40. As shown in FIG. 5, the supply opening 67 is located near the right side surface 74. Therefore, when a user holds a left end portion of the toner container 60 with the left hand, the hand is prevented from becoming dirty with toner deposited on the vicinity of the supply opening 67.

In addition, as shown in FIG. 5, a filling opening 104 for filling toner into the container body 61 is provided on the side surface 63. The filling opening 104 is located, near the left side surface 75, on the side surface 63. That is, the filling opening 104 is located near the left end of the side surface 63. Therefore, the handle 92 is located at the right of the filling opening 104.

Figure 9:
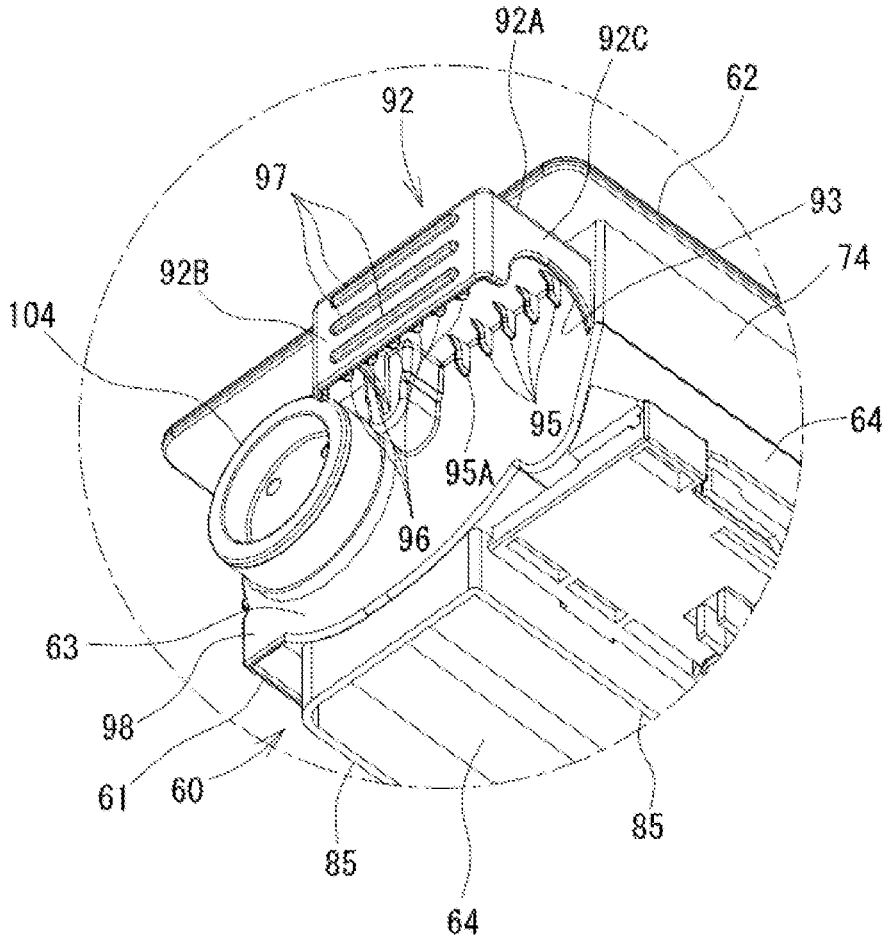
FIG. 9 shows a peripheral structure of a handle of the toner container shown in FIG. 3.

As shown in FIG. 9, the handle 92 includes a perpendicular portion 92A, a bent portion 92B, and a side wall portion 92C. The perpendicular portion 92A has a base end contiguous to the side surface 63, and has a plate-like shape perpendicular to the side surface 63. The bent portion 92B is contiguous to a front end of the perpendicular portion 92A, and has a plate-like shape bent downward from the front end of the perpendicular portion 92A toward the bottom surface 64 of the container body 61. The side wall portion 92C is provided at each of lateral ends (both ends in the right-left direction 9) of the perpendicular portion 92A and the bent portion 92B. An end of each side wall portion 92C on the side surface 63 side is contiguous to the side surface 63.

The side wall portion 92C has a cutout 93 formed by cutting a lower part thereof. The cutout 93 opens downward. The cutout 93 has an arc shape. In the present embodiment, the cutout 93 has substantially a semicircle shape. The cutout 93 having the same shape is formed on each of the side wall portion 92C located on both lateral sides.

Since the cutouts 93 as described above are provided on the handle 92, a user can insert a finger to the back side of the handle 92 without being hindered by the side wall portion 92C, thereby catching the handle 92 with the finger. In addition, a user can put a finger not only on the back side of the handle 92 but also on the cutout 93 of the side wall portion 92C. Thus, load on a finger upon operation of the handle 92 can be dispersed. As a result, operation of the toner container 60 upon mounting or extraction with respect to the image forming apparatus 10 is facilitated, thus improving the operability of the toner container 60.

In addition, as shown in FIG. 9, a first reinforcing rib 95, a second reinforcing rib 96, and a rib 97 for slip stopper are provided on the handle 92. The first reinforcing rib 95 is provided on the back surface of the contiguous portion between the side surface 63 and the perpendicular portion 92A. The first reinforcing rib 95 is formed from the side surface 63 to the perpendicular portion 92A. A plurality of such first reinforcing ribs 95 are arranged in a direction along the contiguous portion between the side surface 63 and the perpendicular portion 92A. The second reinforcing rib 96 is provided on the back surface of the contiguous portion between the perpendicular portion 92A and the bent portion 92B. The second reinforcing rib 96 is formed from the perpendicular portion 92A to the bent portion 92B. A plurality of such second reinforcing ribs 96 are arranged in a direction along the contiguous portion between the perpendicular portion 92A and the bent portion 92B. In the present embodiment, the second reinforcing ribs 96 are respectively located on straight lines extending from the first reinforcing ribs 95 on the back surface of the handle 92. In addition, the rib 97 is provided on the outer surface of the bent portion 92B. The rib 97 extends in the right-left direction 9. Three such ribs 97 are arranged in the up-down direction 7.

Since the reinforcing ribs 95 and 96 as described above are provided, the strength of the handle 92 is enhanced. In addition, since the second reinforcing ribs 96 are provided on the back side of the bent portion 92B, a ball of a finger abuts on the second reinforcing rib 96 when the handle 92 is caught with the finger. Therefore, the second reinforcing ribs 96 prevent slip of the finger in the right-left direction 9, whereby the operability upon handling of the toner container 60 is improved. In addition, since the ribs 97 are provided on the bent portion 92B, slip is suppressed when the handle 92 is held, thus making it easy to hold the handle 92.

In addition, as shown in FIG. 9, in the case where the handle 92 is located at the right with reference to the center of the side surface 63, among the plurality of first reinforcing ribs 95, a first reinforcing rib 95A located near the center of the side surface 63 is formed to be longer in the up-down direction 7 than other first reinforcing ribs 95. Specifically, a portion extending in the up-down direction 7 on the side surface 63, of the first reinforcing rib 95, is formed to be longer in the up-down direction 7 than other first reinforcing ribs 95. Since the first reinforcing ribs 95A are thus formed, of the side surface 63 having a uniformed thickness overall, the center portion which has the weakest strength can be reinforced.

Figure 10:
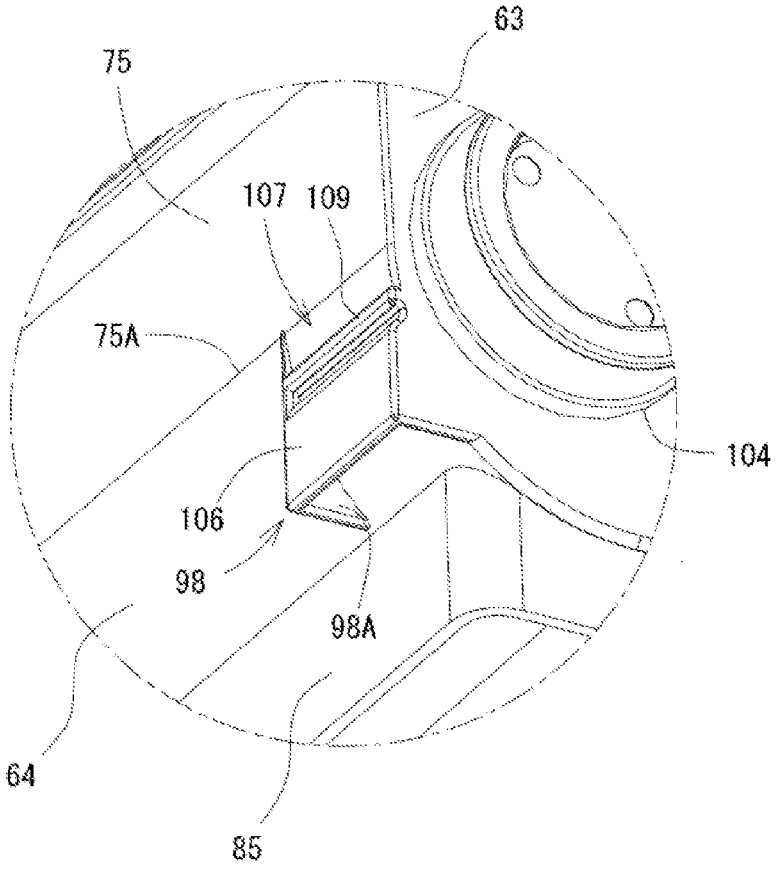
FIG. 10 shows a peripheral structure of a protruding portion of the toner container shown in FIG. 3.

As shown in FIGS. 5 and 10, the container body 61 has the protruding portion 98. The protruding portion 98 is a portion to be engaged with the lock member 90 when the toner container 60 is mounted on the container mounting portion 40. As shown in FIG. 10, the protruding portion 98 protrudes from the curved bottom surface 64 in a direction (leftward) perpendicular to the left side surface 75 (third side surface). A protruding surface 106 present on the same plane as the left side surface 75 is formed at the protruding end of the protruding portion 98. The protruding surface 106 is spaced by a predetermined distance from a boundary 75A between the bottom surface 64 and the left side surface 75. The protruding portion 98 is located, on the left side surface 75 of the container body 61, at the near side end, i.e., the rear end (in the mounting direction) upon insertion when the toner container 60 is mounted on the container mounting portion 40, that is, at the front end of the container body 61. The front end of the protruding portion 98 is contiguous to the side surface 63. On the other hand, a side wall 98A perpendicularly contiguous to the bottom surface 64 is provided at the rear end of the protruding portion 98.

Since the protruding portion 98 as described above is provided, the lock member 90 is securely engaged with the protruding portion 98 as shown in FIG. 2. Thus, the toner container 60 can be securely fixed on the container mounting portion 40.

Figure 11:
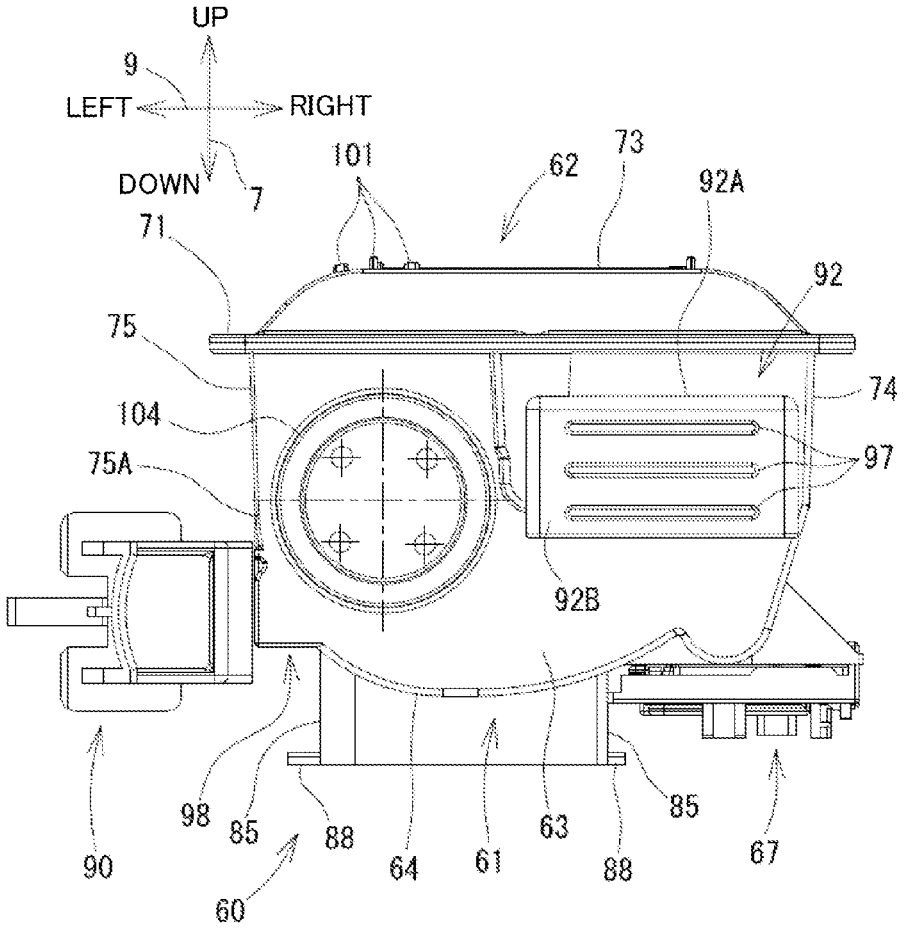
FIG. 11 shows the state in which a lock member contacts the protruding portion of the toner container shown in FIG. 3.
Figure 12:
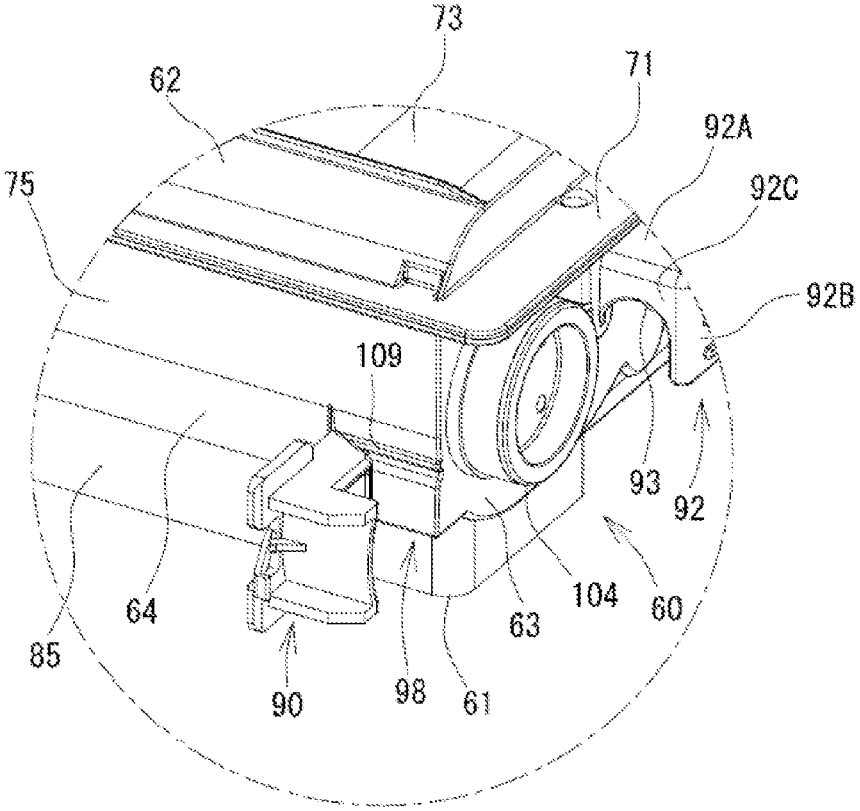
FIG. 12 shows the state in which a lock member contacts the protruding portion of the toner container shown in FIG. 3.

Here, as described above, the container body 61 is formed so as to have a uniformed thickness by injection molding. Therefore, in the present embodiment, as shown in FIG. 10, an area 107 is slightly dented which is an area surrounded by the boundary 75A between the bottom surface 64 and the left side surface 75, the side wall 98A, the upper end of the protruding surface 106, and the side surface 63. In this case, as shown in FIGS. 11 and 12, when the lock member 90 is released and an end of the lock member 90 is slid on the protruding surface 106 and in the area 107, the lock member 90 may contact the side wall 98A to be thereby caught, or abnormal sound may occur upon the catch. In addition, the toner container 60 may be unable to be extracted when the lock member 90 is caught by the side wall 98A. Therefore, in the present embodiment, in the area 107, a reinforcing rib 109 extending in parallel to a direction along the boundary 75A and protruding up to the level of the left side surface 75 is formed integrally with the container body 61. Thus, when the lock member 90 is slid on the protruding surface 106 and in the area 107, the end of the lock member 90 is slid on the reinforcing rib 109, so that the lock member 90 does not contact a step between the area 107 and the side wall 98A upon extraction of the toner container 60, and as a matter of course, abnormal sound does not occur.

It is noted that as shown in FIG. 11, the protruding portion 98 is located at a position corresponding to a midpoint between the upper surface and the bottom surface 64 of the container body 61, on the left side surface 75 of the container body 61. Therefore, when the lock member 90 is engaged with the protruding portion 98, the toner container 60 is not inclined by a force exerted upon the engagement, so that the toner container 60 is stably mounted on the container mounting portion 40.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toner container to be detachably mounted on a container mounting portion of an image forming apparatus, the container mounting portion including:

a pair of guide ditches;

a contact terminal disposed between the pair of guide ditches; and a restriction piece provided in each of the guide ditches in such a way as to protrude from an end portion of each guide ditch toward a center of each guide ditch, the toner container comprising:

a container body that contains toner;

a pair of guide portions provided in such a way as to protrude from a bottom surface of the container body in a direction perpendicular to the bottom surface and extending in a mounting direction toward a mounting position that allows toner to be supplied from the container body to the image forming apparatus, the pair of guide portions allowing the container body to be guided in the mounting direction, the pair of guide portions each having a protrusion piece protruding, in a direction orthogonal to a side surface of the guide portion, from an end of the guide portion in the direction perpendicular to the bottom surface of the container body; and a storage portion attached at a predetermined position, in a vicinity of the protrusion piece, between the pair of guide portions on the bottom surface of the container body, the storage portion being configured to store information about toner contained in the container body, wherein when the container body is inserted in the mounting direction into the container mounting portion, the guide portions are inserted in the mounting direction into the guide ditches of the container mounting portion and guide the container body in the mounting direction while positioning the container body so as not to be displaced in the orthogonal direction, the protrusion pieces are engaged with the restriction pieces and guide the container body so as to be slidable in the mounting direction while positioning the container body so as not to be displaced in the perpendicular direction, and the storage portion contacts the contact terminal in a state where the container body is located at the mounting position.

2. The toner container according to claim 1, wherein the storage portion is attached at a position between the protrusion pieces.

3. The toner container according to claim 2, further comprising a positioning member protruding from a far-side surface in the mounting direction of the container body and allowing the container body to be positioned at the mounting position, wherein the storage portion is attached in a vicinity of an end in the mounting direction on the bottom surface of the container body.

4. The toner container according to claim 3, wherein a depression portion is formed at an end in the mounting direction on the bottom surface of the container body, and the storage portion is attached on the depression portion.

5. The toner container according to claim 2, wherein a depression portion is formed at an end in the mounting direction on the bottom surface of the container body, and the storage portion is attached on the depression portion.

6. The toner container according to claim 1, further comprising a positioning member protruding from a far-side surface in the mounting direction of the container body and allowing the container body to be positioned at the mounting position, wherein the storage portion is attached in a vicinity of an end in the mounting direction on the bottom surface of the container body.

7. The toner container according to claim 6, wherein a depression portion is formed at an end in the mounting direction on the bottom surface of the container body, and the storage portion is attached on the depression portion.

8. The toner container according to claim 1, wherein a depression portion is formed at an end in the mounting direction on the bottom surface of the container body, and the storage portion is attached on the depression portion.

9. An image forming apparatus comprising:

a toner container;

a container mounting portion allowing the toner container to be detachably mounted thereon, the container mounting portion including:

a pair of guide ditches;

a contact terminal disposed between the pair of guide ditches; and a restriction piece provided in each of the guide ditches in such a way as to protrude from an end portion of each guide ditch toward a center of each guide ditch; and an image forming portion that forms an image on a sheet-like recording medium by using toner supplied from the toner container, wherein the toner container includes:

a container body that contains toner;

a pair of guide portions provided in such a way as to protrude from a bottom surface of the container body in a direction perpendicular to the bottom surface and extending in a mounting direction toward a mounting position that allows toner to be supplied from the container body to the image forming portion, the pair of guide portions allowing the container body to be guided in the mounting direction, the pair of guide portions each having a protrusion piece protruding, in a direction orthogonal to a side surface of the guide portion, from an end of the guide portion in the direction perpendicular to the bottom surface of the container body; and a storage portion attached at a predetermined position, in a vicinity of the protrusion piece, between the pair of guide portions on the bottom surface of the container body, the storage portion being configured to store information about toner contained in the container body, wherein when the container body is inserted in the mounting direction into the container mounting portion, the guide portions are inserted in the mounting direction into the guide ditches of the container mounting portion and guide the container body in the mounting direction while positioning the container body so as not to be displaced in the orthogonal direction, and the protrusion pieces are engaged with the restriction pieces and guide the container body so as to be slidable in the mounting direction while positioning the container body so as not to be displaced in the perpendicular direction, and the storage portion contacts the contact terminal in a state where the container body is located at the mounting position.

10. The image forming apparatus according to claim 9, wherein the storage portion is attached at a position between the protrusion pieces.

11. The image forming apparatus according to claim 10, further comprising a positioning member protruding from a far-side surface in the mounting direction of the container body and allowing the container body to be positioned at the mounting position, wherein the storage portion is attached in the vicinity of an end in the mounting direction on the bottom surface of the container body.

12. The image forming apparatus according to claim 11, wherein a depression portion is formed at an end in the mounting direction on the bottom surface of the container body, and the storage portion is attached on the depression portion.

13. The image forming apparatus according to claim 9, further comprising a positioning member protruding from a far-side surface in the mounting direction of the container body and allowing the container body to be positioned at the mounting position, wherein the storage portion is attached in the vicinity of an end in the mounting direction on the bottom surface of the container body.

14. The image forming apparatus according to claim 9, wherein a depression portion is formed at an end in the mounting direction on the bottom surface of the container body, and the storage portion is attached on the depression portion.

* * * * *